US006551968B2

(12) United States Patent
McHenry et al.

(10) Patent No.: US 6,551,968 B2
(45) Date of Patent: Apr. 22, 2003

(54) BIODEGRADABLE POLYNEOPENTYL POLYOL BASED SYNTHETIC ESTER BLENDS AND LUBRICANTS THEREOF

(75) Inventors: Michael A. McHenry, Washington, NJ (US); Dale D. Carr, Morristown, NJ (US); Jeremy P. Styer, Sayreville, NJ (US)

(73) Assignee: Hatco Corporation, Fords, NJ (US)

( * ) Notice: Subject to any disclaimer, the term of this patent is extended or adjusted under 35 U.S.C. 154(b) by 0 days.

(21) Appl. No.: 09/754,932

(22) Filed: Jan. 5, 2001

(65) Prior Publication Data

US 2002/0193260 A1 Dec. 19, 2002

(51) Int. Cl.[7] ..... C10M 105/38; C10M 105/36
(52) U.S. Cl. ..... 508/485; 508/496
(58) Field of Search ..... 508/485, 496

(56) References Cited

U.S. PATENT DOCUMENTS

| | | | | | |
|---|---|---|---|---|---|
| 3,309,318 | A | | 3/1967 | Aylesworth et al. | |
| 3,670,013 | A | | 6/1972 | Leibfried | |
| 3,694,382 | A | | 9/1972 | Kleiman et al. | |
| 4,064,058 | A | | 12/1977 | Walker | |
| 4,072,619 | A | | 2/1978 | Williams et al. | |
| 4,113,635 | A | | 9/1978 | Sakurai et al. | |
| 4,175,045 | A | | 11/1979 | Timony | |
| 4,477,383 | A | | 10/1984 | Beimesch et al. | |
| 4,826,633 | A | | 5/1989 | Carr et al. | |
| 4,851,144 | A | | 7/1989 | McGraw et al. | |
| 5,275,749 | A | | 1/1994 | Kugel et al. | |
| 5,486,302 | A | | 1/1996 | Short | |
| 5,612,299 | A | | 3/1997 | Short | |
| 5,681,800 | A | * | 10/1997 | Duncan et al. | 508/485 |
| 5,705,086 | A | | 1/1998 | Ardito et al. | |
| 5,853,609 | A | * | 12/1998 | Schnur et al. | 252/68 |
| 5,880,075 | A | * | 3/1999 | Hartley et al. | 508/501 |
| 5,895,778 | A | | 4/1999 | McHenry et al. | |
| 5,912,214 | A | * | 6/1999 | Zehler et al. | 508/485 |
| 5,922,658 | A | * | 7/1999 | Duncan et al. | 508/492 |
| 5,925,602 | A | * | 7/1999 | Zehler et al. | 508/485 |
| 5,942,474 | A | * | 8/1999 | Tiffany et al. | 508/485 |
| 5,965,498 | A | * | 10/1999 | Smythe | 508/468 |
| 6,054,420 | A | * | 4/2000 | Hartley et al. | 508/485 |
| 6,197,731 | B1 | * | 3/2001 | Zehler et al. | 508/485 |
| 6,444,626 | B1 | * | 9/2002 | McHenry et al. | 508/495 |

* cited by examiner

*Primary Examiner*—Ellen M. McAvoy
(74) *Attorney, Agent, or Firm*—Reed Smith LLP; Michael I. Wolfson

(57) ABSTRACT

A novel biodegradable polyneopentyl polyol (PNP) ester based synthetic ester basestock that includes a PNP ester admixed with a dicarboxylic acid ester coupling agent is provided. The PNP ester-coupling agent mixture is blended further with minor amounts of a single, or mixture of, additional high molecular weight linear or branched chain ester. The final basestocks are compatible with standard lubricant additive packages and miscible with gasoline to provide biodegradable lubricants that have improved viscosity characteristics, good low temperature properties, and improved lubricity for 2-stroke engine lubricant applications.

32 Claims, No Drawings

BIODEGRADABLE POLYNEOPENTYL POLYOL BASED SYNTHETIC ESTER BLENDS AND LUBRICANTS THEREOF

BACKGROUND OF THE INVENTION

This invention relates generally to synthetic ester basestock blends based on polyneopentyl polyol ("PNP") esters and, more particularly, to basestocks including PNP esters mixed with a coupling agent to increase compatibility with standard lubricant additive packages and provide a highly biodegradable lubricant formulation suitable for use in 2-stroke engines.

There is a continuing need to provide lubricant compositions which are highly biodegradable and are fully miscible with gasoline. This is particularly true with respect to lubricants for 2-stroke engines. These engines are often small gasoline engines used in recreational vehicles, such as motorboats, mono-skis for water use, snowmobiles and in lawn equipment. Thus, all such uses are in sensitive environments subject to pollution. Absent an acceptable biodegradability level, exhaust and leakage of fuel mixed with the lubricant would tend to pollute forests, rivers, lakes and other waterways.

In order for lubricants for 2-stroke engines to be acceptable, they must provide a high viscosity index, acceptable biodegradability, miscibility with gasoline and be compatible with standard lubricant additive packages. Suitable viscometrics include good cold flow properties, such as a pour point less than about −40° C. and a viscosity at −40° C. of less than 36,000 cps and a suitably high flash point, greater than about 240° C.

Biodegradability is measured pursuant to ASTM- 5864 which is similar to the accepted Modified Sturm test adopted by the Organization for Economic Cooperation Development in 1979. These biodegradability tests involve the measurement of the amount of $CO_2$ produced by the test compound, which is, in turn, expressed as a percent of the theoretical $CO_2$ the compound could produce calculated from the carbon content of the test compound. The test is performed to measure released $CO_2$ trapped as $BaCO_3$ and is well known to those in the art and will not be set forth herein in detail. However, the generally accepted ASTM test procedure is incorporated herein by reference.

Generally, lubricants having a biodegradability of over 60% pursuant to ASTM-5864 or the Modified Sturm test are considered to have acceptable biodegradability characteristics.

Examples of biodegradable basestocks based on branched chain synthetic esters and lubricants formed therefrom are disclosed in U.S. Pat. No. 5,681,800. Here, branched chain fatty acids provide the desired viscometrics, low temperature properties, lubricity, biodegradability and solubility of additives therein.

While such biodegradable products are available, it remains desirable to provide a synthetic ester basestock providing all these desirable properties without the use of significant amounts of esters of branched chain acids which do not biodegrade as readily as esters based on straight chain acids.

SUMMARY OF THE INVENTION

Generally speaking, in accordance with the invention, improved synthetic biodegradable polyneopentyl polyol ("PNP") based ester basestocks and lubricants including conventional additive packages soluble therein are provided. The synthetic ester basestocks include PNP esters mixed with a coupling agent to aid in solubility of standard lubricant additive packages in the basestock. The PNP ester and coupling agent may then be blended further with lesser amounts of at least one additional high molecular weight linear or branched chain ester. The additional high molecular weight synthetic ester may be a polyol ester of a linear or branched chain monocarboxylic acid, a dicarboxylic acid ester of linear and/or branched chain monoalcohols, a linear and/or branched monocarboxylic acid ester of linear and/or branched chain monoalcohols, or mixtures thereof.

The PNP ester-coupling agent component of the basestock is a mixture of a polyneopentyl polyol ester, such as a polypentaerythritol ester ("poly PE ester") and a coupling agent. The coupling agent is a compound of intermediate polarity between a hydrocarbon and the polyneopentyl polyol ester, such as esters having an oxygen content from about 4 to 16 weight percent, preferably from about 7 to 13 weight percent. In the preferred embodiment of the invention the coupling agent is an ester which is the reaction product of a dicarboxylic acid having between about 18 to 36 carbon atoms and a mono-alcohol having between about 6 to 14 carbon atoms. Most preferably, the coupling agent is a dimer acid ester which is the reaction product formed by the esterification of dimer acid with a monoalcohol, such as 2-ethylhexanol.

The PNP ester is present in the PNP ester-coupling agent mixture between about 55 to 80 weight percent. The preferred lubricant basestock also includes additional esters blended with the PNP ester and coupling agent mixture. The additional esters are added to adjust the viscometrics of the basestock and modify the lubricity and fluidity of the blend. Typically, the lubricant basestock includes between about 65 to 85 weight percent of the PNP ester-coupling agent mixture with the additional esters being the linear and/or branched chain alcohol-dicarboxylic acid esters, polyol-linear and/or branched monocarboxylic acid esters, linear and/or branched monocarboxylic acid-monoalcohol esters, or mixtures thereof as desired. The synthetic ester blends based on these compositions are then mixed with a standard lubricant additive package to form the biodegradable 2-stroke lubricant.

Accordingly, it is an object of the invention to provide a synthetic ester basestock having improved biodegradability suitable for use in 2-stroke lubricant formulations.

Another object of the invention is to provide an improved 2-stroke lubricant basestock based on polyneopentyl polyol based synthetic esters.

A further object of the invention is to provide an improved 2-stroke lubricant basestock including polyneopentyl polyol esters and a coupling agent to increase solubility of standard lubricant additive packages in the blend.

Yet a further object of the invention is to provide an improved 2-stroke lubricant basestock including polyneopentyl polyol esters and coupling agent admixed with additional high molecular weight esters for adjusting the viscometrics of the lubricant.

Yet another object of the invention is to provide an improved biodegradable polyneopentyl polyol ester based synthetic ester blend which provides the desired viscometrics, low temperature properties, lubricity, miscibility with gasoline and solubility of additives in the finished formulation.

Still other objects and advantages of the invention will in part be obvious and will in part be apparent from the specification.

The invention accordingly comprises a composition of matter possessing the characteristics, properties, and the relation of components which will be exemplified in the compositions hereinafter described, and the scope of the invention will be indicated in the claims.

DESCRIPTION OF THE PREFERRED EMBODIMENTS

The biodegradable 2-stroke synthetic ester basestocks and lubricants prepared in accordance with the invention are blends which include at least two synthetic esters. These esters are a polyneopentyl polyol (PNP) ester admixed with a coupling agent. The coupling agent is a molecule that increases the solubility of standard lubricant additive packages in the PNP ester based lubricant. The coupling agent is a compound of intermediate polarity between a hydrocarbon and the polyneopentyl polyol ester, such as esters having an oxygen content from about 4 to 16 weight percent, preferably from about 7 to 13 weight percent. In order to attain the desired viscosity, pour point, flash point and other properties of the final basestock blend, one or more additional esters such as a polyol ester of a linear and/or branched chain monocarboxylic acid, a dicarboxylic acid ester of a linear and/or branched chain monoalcohol, or a linear and/or branched monocarboxylic acid ester of linear and/or branched chain monoalcohols, or mixtures thereof is additionally added to the PNP ester-coupling agent mixture.

In the preferred embodiments of the invention, the basestock is a blend of the PNP ester-coupling agent mixture and one or more esters chosen from:

(1) polyol esters of linear and/or branched monocarboxylic acids, (2) dicarboxylic acid esters of linear and/or branched monoalcohols, and (3) linear and/or branched monocarboxylic acid esters of linear and/or branched monoalcohols.

The polyols for forming the polyol esters of linear and/or branched monocarboxylic acids are those having from 3 to 8 carbon atoms. The monoalcohols utilized are those having from about 6 to 22 carbon atoms. The monocarboxylic acids have from 6 to 20 carbon atoms and the dicarboxylic acids from 6 to 18 carbon atoms.

The PNP ester-coupling agent mixture includes at least 50 weight percent polyneopentyl polyol esters. The neopentyl polyol utilized to prepare compositions in accordance with the invention is at least one neopentyl polyol represented by the structural formula:

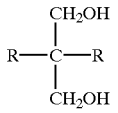

wherein each R is independently selected from the group consisting of $CH_3$, $C_2H_5$ and $CH_2OH$. Examples of such a neopentyl polyol include pentaerythritol, trimethylolpropane, trimethylolethane, neopentyl glycol and the like. In some embodiments of this invention, the neopentyl polyol comprises only one such neopentyl polyol. In other embodiments it comprises two or more such neopentyl polyols.

Preferably, the polyneopentyl polyol ester is the reaction product of a mixture of partial esters of the neopentyl polyol with a suitable monocarboxylic acid(s). When the neopentyl polyol utilized is pentaerythritol, the polypentaerythritol moiety of the reaction product ("poly PE") includes pentaerythritol, dipentaerythritol, tripentaerythritol, tetrapentaerythritol, etc. The reaction products are formed by reacting pentaerythritol with at least one monocarboxylic acid having from about 5 to 18 carbon atoms in the presence of an excess of hydroxyl groups relative to carboxyl groups. Subsequently, the partial esters are reacted with excess monocarboxylic acid(s) to obtain the polyneopentyl polyol ester. Most preferably, the acid moieties in the polyneopentyl polyol esters have from 7 to 10 carbon atoms and are linear. In the most preferred aspect of the invention, the acid component of the polyneopentyl polyol ester is a linear monocarboxylic acid, or a mixture of linear monocarboxylic acids, which contain up to about 5 weight percent or less branched chain acids.

Suitable acids for forming the polyneopentyl polyol esters include, but are not limited to, valeric acid, oenanthic acid, caprylic acid, pelargonic acid, capric acid, and isostearic acid. Preferably, the straight chain acid is a mixture of heptanoic ($C_7$) and caprylic-capric ($C_8$–$C_{10}$). The caprylic-capric acid is usually identified as being a mixture of 8 and 10 carbon atom acids, but actually includes $C_6$ to $C_{12}$ acids, including trace amounts of $C_6$ (generally less than about 5 weight percent) and less than about 2% of $C_{12}$. Use of only linear acids to prepare the esters increases the biodegradability and viscosity index of the resulting polyneopentyl polyol ester.

The initial stage of the reaction to form the PNP esters is conducted in the manner described by Leibfried in U.S. Pat. No. 3,670,013 and in commonly assigned U.S. Pat. No. 5,895,778. The descriptions of both patents are incorporated herein by reference. Here, when pentaerythritol is the neopentyl polyol, a reaction mixture of pentaerythritol (272 w) and valeric acid (217 v) is placed into a reactor with extra valeric acid (38 v) in a receiver to assure a constant level of valeric acid in the reaction mixture. The mixture is heated to a temperature of 171° C. and concentrated sulfuric acid (1.0 w) diluted with water (2 v) is added. The reaction mixture is heated to 192° C. and maintained until 50.5 v of water is removed after about 1.4 hours. The Leibfried analysis of the product shows pentaerythritol, dipentaerythritol, tripentaerythritol and tetrapentaerythritol at weight ratios of 34:38:19:8.

In the present case, the polypentaerythritol partial esters are prepared by introducing a reaction mixture of pentaerythritol and a linear monocarboxylic acid having from 7 to 12 carbon atoms in an initial mole ratio of carboxyl groups to hydroxyl groups of about 0.25:1 to about 0.5:1 and an effective amount of an acid catalyst material into a reaction zone as described in the Leibfried patent.

When the PNP esters are prepared for use in the blends in accordance with the invention, the neopentyl polyol and selected acid or acid mixtures are mixed in the presence of a strong acid catalyst and heated. The reaction is continued until the desired viscosity of the reaction mixture is reached. At this point when the starting neopentyl polyol is pentaerythritol, the mixture includes partial esters of pentaerythritol, dipentaerythritol, tripentaerythritol, tetrapentaerythritol and the like. In order to complete the esterification of the partial esters, an excess of the acid or acid mixture is added to the reaction mixture which is then heated, water of reaction removed and acid returned to the reactor.

The acid catalyst is at least one acid esterification catalyst. Examples of acid esterification catalysts include mineral acids, preferably, sulfuric acid, hydrochloric acid, and the like, acid salts such as, for example, sodium bisulfate, sodium bisulfite, and the like, sulfonic acids such as, for example, benzenesulfonic acid, toluenesulfonic acid, polystyrene sulfonic acid, methylsulfonic acid, ethylsulfonic acid, and the like. The reaction mixture is heated to between about 150° and 200° C. while withdrawing acid vapor and water vapor to yield the poly(pentaerythritol) partial ester product.

Prior to esterifying the partial esters, the intermediate product will include a variety of condensation products of the neopentyl polyol. When pentaerythritol is the neopentyl polyol, the reaction mixture will include significantly more pentaerythritol than the 10 to 15 weight percent generally present in commercially available dipentaerythritol. Depending on the initial ratio of carboxyl groups to hydroxyl groups and selection of reaction conditions, the partial ester product may include the following components in the weight ranges specified in the following table.

| Pentaerythritol Moiety | Weight Percent |
|---|---|
| Pentaerythritol | 30 to 45 |
| Dipentaerythritol | 30 to 45 |
| Tri/tetrapentaerythritol | 20 to 35 |
| Other Polypentaerythritols | 3 to 15 |

The amount of the preferred heptanoic and caprylic-capric acid mixture for preparing the polyneopentyl polyol esters may vary widely. Initially, an excess of hydroxyl groups to carboxylic acid groups is present to form the partial esters of the neopentyl polyol, such as partial esters of pentaerythritol, dipentaerythritol, tripentaerythritol, tetrapentaerythritol, etc. The excess of hydroxyl groups is necessary to promote the polymerization of the partial esters. The molar ratio of acid mixture to the polyol can be varied depending on the desired degree of condensation and the ultimate desired viscosity of the lubricant. After formation of the partial esters, generally, a 10 to 25 percent excess, with respect to hydroxyl groups, of the mixture of heptanoic acid and $C_8$–$C_{10}$ acid is added to the reactor vessel and heated. Water of reaction is collected during the reaction while the acids are returned to the reactor. The use of a vacuum will facilitate the reaction. When the hydroxyl value is reduced to a sufficiently low level, the bulk of the excess acid is removed by vacuum distillation. Any residual acidity is neutralized with an alkali. The resulting polyneopentyl polyol ester is dried and filtered as described in Example 1 below.

The coupling agent, which is mixed with the PNP ester to form the PNP ester-coupling agent mixture, is a compound of intermediate polarity between a hydrocarbon and the polyneopentyl polyol ester, such as esters having an oxygen content from about 4 to 16 weight percent, preferably from about 7 to 13 weight percent. In the preferred embodiment of the invention the coupling agent is an ester which is the reaction product of a dicarboxylic acid having between about 18 to 36 carbon atoms and a monoalcohol having between about 6 to 13 carbon atoms. Most preferably, the coupling agent is a dimer acid ester which is the reaction product formed by the esterification of dimer acid with a monoalcohol, such as 2-ethylhexanol. Preferably, the dicarboxylic acid is dimer acid prepared from oleic acid which is heated to form the dimer, a 36 carbon diacid which results from a Diels-Alder type reaction. The 36 carbon dimer acid is then esterified with a branched chain monoalcohol having from 6 to 13 carbon atoms and preferably, 6 to 10 carbon atoms. In the most preferred embodiment, the monoalcohol is 2-ethylhexanol which forms di-2-ethylhexyl dimerate as described in Example 2 below.

The initial PNP ester-coupling agent mixture for the basestock is formed by mixing the polyneopentyl polyol esters together with the coupling agent, such as the dimer acid ester. Generally, at least 50 weight percent, and preferably 55 to 80 weight percent of the polyneopentyl polyol ester is admixed with between about 20 to 45 weight percent of dicarboxylic acid ester to form the PNP ester-coupling agent mixture. In the most preferred aspects of the invention, the initial PNP ester-coupling agent mixture is between about one to three parts and most preferably about two parts PNP ester to one part dicarboxylic acid ester by weight. Conventional lubricant additive packages are generally soluble in this PNP based ester mixture. However, additional esters may be blended with this mixture to provide desired lubricant properties.

The additional esters blended with the initial PNP ester-coupling agent mixture yield basestocks having desired viscometric properties. The additional esters are (1) polyol esters of linear and/or branched chain monocarboxylic acids, (2) dicarboxylic acid esters of linear and/or branched chain monoalcohols, (3) linear and/or branched monocarboxylic acid esters of linear and/or branched monoalcohols, or (4) mixtures thereof. Generally, the PNP ester-coupling agent mixture is present in the basestock blend at between about 60 to 90 weight percent with the additional esters present at between about 10 to 40 weight percent, based on the total weight of the basestock. In the most preferred aspects of the invention, the basestock includes a PNP ester-coupling agent mixture in an amount between about 65 to 85 and most preferably about 70 to 80 weight percent, with the balance being additional ester.

The additional ester may be a single ester or mixture of esters. The additional esters may be esters of a polyol and linear and/or branched chain monocarboxylic acids. The polyol may be a neopentyl polyol as described above and the monocarboxylic acid will have from about 5 to 20, and preferably 6 to 18 carbon atoms. A preferred example of the polyol is trimethylolpropane and a preferred example of the acid is oleic acid with the resulting ester being TMPtrioleate.

The additional ester may also be an ester of linear and/or branched chain monoalcohols and dicarboxylic acids that can vary depending on the specific properties desired. The branched chain monoalcohols utilized to form the esters will have from about 9 to 15 carbon atoms and are esterified with dicarboxylic acids having from about 5 to 12 carbon atoms, such as sebacic acid and adipic acid. Examples of preferred esters are diisotridecyl sebacate and diisodecyl adipate.

When the additional ester is a mixture of diisotridecyl sebacate and diisodecyl adipate, the diisotridecyl sebacate will be present in amounts between about 50 to 70 weight percent, preferably about 55 to 65 weight percent, and most preferably about 60 weight percent of the additional ester mixture. The balance is between about 30 to 50 weight percent diisodecyl adipate, preferably between about 35 to 45 weight percent, and most preferably about 40 weight percent of the additional ester mixture.

When the ester is formed from a monoalcohol and a monocarboxylic acid, the monoalcohol will have from about 6 to 20 carbon atoms and the monocarboxylic acid will have from about 6 to 22 carbon atoms. In the most preferred embodiment, the alcohol is 2-ethylhexanol and the acid is oleic acid with the resulting ester being 2-tethylhexyloleate.

The lubricant basestock is prepared by blending the polyneopentyl polyol ester and coupling agent mixture with the additional ester or ester mixture. The additional esters will be present in amounts between 10 to 40 weight percent, preferably between about 20 to 30 weight percent. In a preferred aspect of the invention, a typical composition will be as follows:

| Ester | Weight Percent |
|---|---|
| Polypentaerythritol $C_{7-10}$ ester | 50 |
| 2-Ethylhexyl dimerate | 25 |
| Diisotridecyl sebacate | 15 |
| Diisodecyl adipate | 10 |

In another preferred embodiment of the invention, the additional ester is an ester of a high molecular weight monocarboxylic acid having from 16 to 20 carbon atoms and a branched chain alcohol or polyol having from 5 to 10 carbon atoms. In this preferred embodiment of the invention, the additional ester is a blend of 2-ethylhexyl oleate and trimethylolpropane trioleate. When these preferred esters are utilized as the additional ester, the trimethylolpropane trioleate ester is present in amounts between about 45 to 75 weight percent of the additional ester and preferably 60 to 70 weight percent, with the 2-ethylhexyl oleate present at between about 25 to 55 weight percent, and preferably 30 to 40 weight percent. In the most preferred embodiment of this aspect of the invention, the basestock will include the following:

| Polyol Ester | Weight Percent |
|---|---|
| Polypentaerythritol $C_{7-10}$ ester | 50 |
| 2-Ethylhexyl dimerate | 25 |
| 2-Ethylhexyl oleate | 10 |
| Trimethylolpropane trioleate | 15 |

Biodegradable 2-stroke lubricants, including the ester basestocks prepared in accordance with the invention, are prepared by mixing a conventional additive package in the synthetic ester basestock in conventional concentrations. Suitable lubricant additive packages are described in detail in U.S. Pat. No. 5,674,822, the disclosure of which is incorporated herein by reference. Such additives are generally added in amounts ranging from about 1 to 15 percent by weight, based on the total weight of the composition.

In order to be acceptable as a basestock for a 2-stroke lubricant, the basestock should meet the following typical specifications:

| Desired Property | Specification |
|---|---|
| Water Content, ppm | 500 max |
| Appearance | clear and sediment free |
| Viscosity, cSt @ 100° C. | 8.5–10.0 |
| Viscosity, cSt @ 40° C. | 45–65 |
| Viscosity, cSt @ −40° C. | 36,000 max |
| Pour point, ° C. | −35 max |
| Flash point, ° C. | 240 min |
| Density at 15.6° C., lbs/gal | 7.75–8.00 |
| Total Acid Number, mgKOH/g | 0.25 max |

A key feature of a basestock and lubricant for 2-stroke engines is biodegradability. As noted above, biodegradability as measured by ASTM-5864 in excess of about 60% is generally considered acceptable. In all cases, standard lubricant additive packages must be compatible in the ester basestock blend, which in turn must be miscible with gasoline. Typical lubricant additive packages are generally not fully compatible with polyneopentyl polyol esters. However, upon appropriate blending of the initial PNP ester with a coupling agent, such as dicarboxylic acid esters, the additive packages are then sufficiently compatible with the blend so that the polyneopentyl polyol esters so that they can be utilized in large percentages in these 2-stroke lubricant formulations. The additional ester mixtures that are blended together with the PNP ester-coupling agent mixture are added to adjust and provide the desired viscometrics, such as high viscosity index and low pour point, a high flash point and also to provide a high degree of lubricity, good biodegradability and compatibility with the lubricant additive packages.

The invention will be better understood with references to the following examples. All percentages are set forth in percentages by weight except when molar quantities are indicated. These examples are presented for purposes of illustration only, and are not intended to be construed in a limiting sense.

The reactor in each preparatory example is equipped with a mechanical stirrer, thermocouple, thermoregulator, Dean Stark trap, condenser, nitrogen sparger, and vacuum source. The esterification may or may not be carried out in the presence of esterification catalysts, which are well known in the art.

EXAMPLE 1

To a reactor as described above was charged pentaerythritol (1.68 moles), heptanoic acid (2.46 moles), $C_8$–$C_{10}$ acid (0.34 moles) and a strong acid catalyst as described in Leibfried.

The mixture was heated to a temperature of about 190° C. and water of reaction was removed and collected in the trap. Vacuum was applied at temperature to obtain a reflux thereby removing the water and returning the acid collected in the trap to the reactor.

The viscosity of the reaction mixture was monitored and when the desired viscosity was obtained an amount of alkali was added to the reactor to neutralize the acid catalyst. At this point the reaction mixture consists of partial esters of pentaerythritol, dipentaerythritol, tripentaerythritol, tetrapentaerythritol, etc.

In the same ratio as the initial charge plus a 10–15% excess relative to the remaining hydroxyl content, heptanoic acid and $C_8$–$C_{10}$ acid were added to the reactor. The vessel was then heated to about 230° C. The water of reaction was collected in a trap during the reaction, while the acids were returned to the reactor. Vacuum was applied to facilitate the reaction. When the hydroxyl value was reduced to a sufficiently low value, the bulk of the excess acid was removed by vacuum distillation. The residual acidity was neutralized with an alkali. The resulting product was dried and filtered.

Depending on the initial ratio of carboxyl groups to hydroxyl groups and selection of reaction conditions, the PNP ester product may include the following components in the weight percentage ranges specified in the following table.

| Pentaerythritol Moiety | Weight Percent |
|---|---|
| Pentaerythritol | 30 to 45 |
| Dipentaerythritol | 30 to 45 |
| Tri/tetrapentaerythritol | 20 to 35 |
| Other Pentaerythritols | 3 to 15 |

When a standard additive package was mixed with the PNP ester, the additive package was compatible at 65° C., hazy at ambient temperature and at 6° C., with light precipitation occurring after 2 weeks at 6° C.

EXAMPLE 2

A 2-ethylhexyl dimerate ester coupling agent is formed by reacting dimer acid with 2-ethylhexanol. The dimer acid and 2-ethylhexanol in an excess of about 10–15% are charged to the reactor vessel. The vessel is heated and water of reaction is collected in the trap and unreacted alcohol is returned to the reactor. Vacuum is applied to maintain the reaction. When the acid value is reduced to a sufficiently low level, the bulk of the excess alcohol is removed via vacuum distillation and/or steam stripping. The resulting ester product is dried and filtered.

The 2-ethylhexyl dimerate ester coupling agent is mixed with the PNP ester product of Example 1 in a 1:2 parts by weight ratio. This mixture of 2-ethylhexyl dimerate ester and PNP ester is then further mixed with a standard additive package as used in Example 1. This ester blend was fully compatible with the additive package when tested as in Example 1.

EXAMPLE 3

A diisotridecyl sebacate ester is formed by reacting sebacic acid with isotridecyl alcohol. The sebacic acid and isotridecyl alcohol in an excess of about 10–15% are charged to the reactor vessel. The vessel is heated and water of reaction is collected in the trap and unreacted alcohol is returned to the reactor. Vacuum is applied to maintain the reaction. When the acid value is reduced to a sufficiently low level, the bulk of the excess alcohol is removed via vacuum distillation and/or steam stripping. The residual acidity is neutralized with an alkali. The resulting ester product is dried and filtered.

EXAMPLE 4

A diisodecyl adipate ester is formed by reacting adipic acid with isodecyl alcohol. The adipic acid and isodecyl alcohol in an excess of about 10–15% are charged to the reactor vessel. The vessel is heated and water of reaction is collected in the trap and unreacted alcohol is returned to the reactor. Vacuum is applied to maintain the reaction. When the acid value is reduced to a sufficiently low level, the bulk of the excess alcohol is removed via vacuum distillation and/or steam stripping. The residual acidity is neutralized with an alkali. The resulting ester product is dried and filtered.

EXAMPLE 5

A 2-ethylhexyl oleate ester is formed by reacting oleic acid with 2-ethylhexanol. The oleic acid and 2-ethylhexanol in an excess of about 10–15% are charged to the reactor vessel. The vessel is heated and water of reaction is collected in the trap and unreacted alcohol is returned to the reactor. Vacuum is applied to maintain the reaction. When the acid value is reduced to a sufficiently low level, the bulk of the excess alcohol is removed via vacuum distillation and/or steam stripping. The resulting ester product is dried and filtered.

EXAMPLE 6

A trimethylolpropane trioleate ester is formed by reacting oleic acid with an excess of trimethylolpropane (TMP). The polyol and acid are charged to the reactor vessel in a mole ratio of about 1 to 2.6 (i.e., about 3 equivalents of hydroxyl groups to 2.6 equivalents of carboxyl groups). The vessel is heated and water of reaction is collected in the trap during the reaction. Vacuum is applied to maintain the reaction. When the acid value is reduced to a sufficiently low level, the resulting polyol ester product is dried and filtered.

EXAMPLE 7

An initial PNP-dimer acid mixture is prepared by mixing two parts PNP ester prepared in Example 1 with one part dimer acid ester prepared in Example 2. Two basestock blends having the following composition by weight were prepared from this initial blend. These were each admixed with a suitable additive package and were then evaluated for biodegradability pursuant to ASTM-5864. The composition of the basestock blends and the biodegradability results of the finished 2-stroke lubricants made from the basestocks are as follows:

| Ester | Blend A | Blend B |
|---|---|---|
| Polypentaerythritol $C_{7-10}$ ester | 50 | 50 |
| 2-Ethylhexyl dimerate | 25 | 25 |
| Diisotridecyl sebacate | 15 | – |
| Diisodecyl adipate | 10 | – |
| 2-Ethylhexyl oleate | – | 10 |
| Trimethylolpropane trioleate | – | 15 |
| Property | | |
| Biodegradability | 73.6% | 65.9% |

Both 2-stroke lubricants having the compositions of Blend A and Blend B as set forth above were fully satisfactory when added to gasoline and used in 2-stroke engines. As shown, both basestock blends exhibit biodegradability well in excess of the 60% considered to be acceptable for 2-stroke lubricants.

It will thus be seen that the objects set forth above, among those made apparent from the preceding description, are efficiently attained and, since certain changes may be made in the above compositions of matter without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A biodegradable 2-stroke engine lubricant basestock composition, comprising:

(a) between about 40 to 60 parts by weight of polyneopentyl polyol esters, (b) between about 15 to 35 parts by weight of a dicarboxylic acid ester coupling agent formed by reacting a dicarboxylic acid having 18 to 36 carbon atoms with a linear or branched chain monoalcohol, the coupling agent promoting the compatibility of the finished ester basestock with traditional 2-stroke lubricant additives, and (c) the balance of at least one additional ester for adjusting the physical properties of the lubricant, selected from the group consisting of:

(1) polyol esters of linear and/or branched monocarboxylic acids, (2) dicarboxylic acid esters of dicarboxylic acids having from about 5 to 12 carbon atoms and linear and/or branched monoalcohols, (3) linear and/or branched monocarboxylic acid esters of linear and/or branched monoalcohols, and (4) mixtures thereof all parts by weight based on the total weight of the basestock.

2. The composition of claim 1, wherein the polyneopentyl polyol ester is formed by (i) reacting a neopentyl polyol with at least one linear and/or branched monocarboxylic acid having from 5 to 18 carbon atoms in the presence of an excess of hydroxyl groups in a mole ratio of carboxyl groups to hydroxyl groups in the reaction mixture in a range from about 0.25:1 to about 0.50:1 and an acid catalyst to form partial polyneopentyl polyol esters and (ii) reacting the partial polyneopentyl polyol esters with an excess of at least one linear monocarboxylic acid having from 5 to 18 carbon atoms to yield with the final ester product.

3. The composition of claim 1, wherein the polyneopentyl polyol ester is formed from a polyneopentyl polyol partial ester which is formed from a neopentyl polyol represented by the following structural formula:

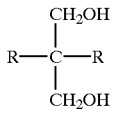

wherein each R is selected from the group consisting of —$CH_3$, —$C_2H_5$, and —$CH_2OH$.

4. The composition of claim 3, wherein the neopentyl polyol is a polyol selected from the group consisting of pentaerythritol, trimethylopropane, trimethylolethane, neopentyl glycol, and mixtures thereof.

5. The composition of claim 3, wherein the neopentyl polyol is pentaerythritol.

6. The composition of claim 1, wherein the polyneopentyl polyol ester is present between about 45 to 55 parts by weight and the coupling agent is present between about 20 to 30 parts by weight.

7. The composition of claim 1, wherein the monoalcohol reacted to form the coupling agent is a linear or branched chain monoalcohol having from 6 to 10 carbon atoms.

8. The composition of claim 1, wherein the dicarboxylic acid reacted to form the coupling agent is dimer acid.

9. The composition of claim 1, wherein the monoalcohol reacted to form the coupling agent is 2-ethylhexanol.

10. The composition of claim 1, wherein the coupling agent is di-2-ethylhexyl dimerate.

11. The composition of claim 1, wherein the additional ester is a polyol ester of a linear monocarboxylic acid.

12. The composition of claim 11, wherein the acid is a saturated or unsaturated monocarboxylic acid having from 6 to 20 carbon atoms.

13. The composition of claim 11, wherein the polyol ester is formed by esterifying a neopentyl polyol.

14. The composition of claim 13, wherein the neopentyl polyol is trimethyolpropane.

15. The composition of claim 13, wherein the ester is trimethylolpropane trioleate.

16. The composition of claim 1, wherein the additional ester is a dicarboxylic acid ester of at least one linear and/or branched monoalcohol.

17. The composition of claim 16, wherein the monoalcohol reacted to form the additional ester has from 6 to 22 carbon atoms.

18. The composition of claim 17, wherein the monoalcohol reacted to form the additional ester is selected from isotridecyl alcohol and isodecyl alcohol, and the ester is selected from the group consisting of diisotridecyl sebacate, diisodecyl adipate, and mixtures thereof.

19. The composition of claim 1, wherein the additional ester is the reaction product of a linear and/or branched monocarboxylic acid and a linear and/or branched monoalcohol.

20. The composition of claim 19, wherein the monoalcohol is a branched chain monoalcohol having from 6 to 10 carbon atoms.

21. The composition of claim 20, wherein the branched chain monoalcohol is 2-ethylhexanol.

22. The composition of claim 19, wherein the monocarboxylic acid is a saturated or unsaturated monocarboxylic acid having from 6 to 20 carbon atoms.

23. The composition of claim 22, wherein the acid is oleic acid.

24. The composition of claim 19, wherein the monocarboxylic acid is oleic acid and the reaction product is 2-ethylhexyl oleate.

25. A biodegradable 2-stroke engine lubricant basestock composition comprising:

(a) between about 40 and 60 percent by weight of polyneopentyl polyol esters formed by (i) reacting a neopentyl polyol with at least one linear monocarboxylic acid having from 7 to 12 carbon atoms in the presence of an excess of hydroxyl groups in a mole ratio of carboxyl groups to hydroxyl groups in the reaction mixture in a range from about 0.25:1 to about 0.50:1 and an acid catalyst to form partial polyneopentyl polyol esters and (ii) reacting the partial polyneopentyl polyol esters with an excess of at least one linear monocarboxylic acid having from 7 to 12 carbon atoms and less than about five weight percent branched acids to complete the esterification, (b) between about 15 to 35 weight percent of a coupling agent formed by reacting a dicarboxylic acid having 18 to 36 carbon atoms and a monoalcohol having 6 to 10 carbon atoms, and (c) between about 15 to 40 weight percent of at least one additional ester selected from the group consisting of:

(1) polyol esters of linear and/or branched monocarboxylic acids, (2) dicarboxylic acid esters of dicarboxylic acids having from about 5 to 12 carbon atoms and linear and/or branched monoalcohols, (3) linear and/or branched monocarboxylic acid esters of linear and/or branched monoalcohols, and (4) mixtures thereof for adjusting the physical properties of the composition, with the weight percents of the esters in the blend based on the total eight of the composition.

26. The composition of claim 25, wherein the monoalcohol reacted to form the coupling agent is a monoalcohol having from 6 to 10 carbon atoms.

27. The composition of claim 25, wherein the dicarboxylic acid ester coupling agent is a dimer acid ester.

28. The composition of claim 26, wherein the coupling agent is di-2-ethylhexyl dimerate.

29. A method of lubricating a 2-stroke engine which comprises contacting moving components of the engine to be lubricated with an effective amount of a synthetic lubricant including a basestock, comprising:

(a) between about 40 to 60 parts by weight of polyneopentyl polyol esters, (b) between about 15 to 35 parts by weight of an ester coupling agent formed by reacting a dicarboxylic acid having 18 to 36 carbon atoms which promotes the compatibility of the finished ester basestock with traditional 2-stroke lubricant additives; and (c) the balance of an additional esters selected from the group consisting of:

(1) polyol esters of linear and/or branched monocarboxylic acids, (2) dicarboxylic acid esters of dicarboxylic acids having from about 5 to 12 carbon atoms and linear and/or branched monoalcohols, (3) linear and/or branched monocarboxylic acid esters of linear and/or branched monoalcohols, and (4) mixtures thereof for adjusting the physical properties of the lubricant, all parts by weight based on the total weight of the basestock.

30. The method of claim 29, wherein the polyneopentyl polyol ester is formed by (i) reacting a neopentyl polyol with at least one linear and/or branched monocarboxylic acid having from 5 to 18 carbon atoms in the presence of an excess of hydroxyl groups in a mole ratio of carboxyl groups to hydroxyl groups in the reaction mixture in a range from about 0.25:1 to about 0.50:1 and an acid catalyst to form partial polyneopentyl polyol esters and (ii) reacting the partial polyneopentyl polyol esters with an excess of at least one linear monocarboxylic acid having from 5 to 18 carbon atoms to complete the esterification.

31. The method of claim 26, wherein the basestock includes about:

| Ester | Parts by Weight |
|---|---|
| Polypentaerythritol $C_{7-10}$ ester | 50 |
| 2-Ethylhexyl dimerate | 25 |
| Diisotridecyl sebacate | 15 |
| Diisodecyl adipate | 10. |

32. The method of claim 26, wherein the basestock includes about:

| Ester | Parts by Weight |
|---|---|
| Polypentaerythritol $C_{7-10}$ ester | 50 |
| 2-Ethylhexyl dimerate | 25 |
| 2-Ethylhexyl oleate | 10 |
| Trimethylolpropane trioleate | 15. |

* * * * *